US006561868B1

(12) United States Patent
Edwards et al.

(10) Patent No.: US 6,561,868 B1
(45) Date of Patent: May 13, 2003

(54) SYSTEM AND METHOD FOR CONTROLLING A POLISHING MACHINE

(75) Inventors: Henry Litzmann Edwards, Garland, TX (US); Sung-Jen Fang, Richardson, TX (US); Thomas M. Moore, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/727,187

(22) Filed: Nov. 30, 2000

Related U.S. Application Data

(60) Provisional application No. 60/171,343, filed on Dec. 21, 1999.

(51) Int. Cl.[7] ..... B24B 49/00

(52) U.S. Cl. ..... 451/8; 451/8; 451/9; 451/41; 451/288

(58) Field of Search ..... 451/8, 9, 41, 288, 451/289, 388

(56) References Cited

U.S. PATENT DOCUMENTS 5,099,614 A * 3/1992 Arai et al. ..... 51/165

6,080,050 A * 6/2000 Chen et al. ..... 451/288

* cited by examiner

*Primary Examiner*—Joseph J. Hail, III
*Assistant Examiner*—Alvin J. Grant
(74) *Attorney, Agent, or Firm*—Jacqueline J. Garner; Wade James Brady, III; Frederick J. Telecky, Jr.

(57) ABSTRACT

A system for controlling a polishing machine during polishing of a workpiece, such as a semiconductor wafer, includes a carrier which has an interface surface for engaging a workpiece and establishing ultrasonic coupling thereto. At least one crystal oscillator is ultrasonically coupled to the carrier and operates at a resonant frequency in an ultrasonic band which is indicative of a desired polishing depth of the workpiece, such as the endpoint of polishing. A detector circuit provides an output signal which is representative of an output level of the crystal oscillator. A processor circuit receives the signal from the detector circuit and provides a signal to the polishing machine when the amplitude of the signal from the detector circuit indicates that the desired polishing endpoint has been reached. A number of crystal oscillators can be spatially arranged on the carrier to establish a local polishing depth detection array.

20 Claims, 3 Drawing Sheets

SYSTEM AND METHOD FOR CONTROLLING A POLISHING MACHINE

This application claims priority under 35 USC §119(e) (1) of provisional application No. 60/171,343 filed Dec. 21, 1999.

TECHNICAL FIELD OF THE INVENTION

This invention relates generally to the field of semiconductor manufacturing, and more particularly to polishing operations in semiconductor manufacturing.

BACKGROUND OF THE INVENTION

In manufacturing semiconductor integrated circuit components, chemical-mechanical polishing (CMP) can be used to prepare surfaces during fabrication. In the case of shallow trench isolation (STI) techniques, such as illustrated in FIGS. 1A through 1D, a device is generally formed on a silicon substrate 102, with a pad oxide layer 104 and a nitride layer 106 formed thereon. Standard methods, such as chemical or ion etching, can be used to form the shallow trench 108 through the nitride layer 106, pad oxide layer 104 and partially penetrating the substrate 102. The trench 108 can then be backfilled by depositing a fill oxide layer 110 over the nitride layer 106. CMP then can be used to remove the fill oxide layer 110 from the surface of the nitride layer 106, leaving the trench 108 filled and, preferably, the nitride layer 106 substantially intact. Following CMP, the nitride layer 106 can then be selectively removed such that only the pad oxide layer and oxide filling the trench remain. To achieve this result, the CMP process should be terminated before the nitride layer 106 is substantially impinged and before the pad oxide layer 104 is impinged.

FIG. 1E illustrates a non-ideal case where CMP was applied to the structure of FIGS. 1A–1D. In this case, as a result of dishing during the CMP process, the pad oxide layer 104 is penetrated by the polishing process resulting in damage to the active layer of the device, as shown generally by region 112.

There are methods known in the prior art for performing end point detection with CMP. For example, the electrical current required to drive the platen which rotates a polishing pad at a fixed rate, or the current required to drive the wafer carrier, can be monitored to detect the nitride layer 106/pad oxide layer 104 interface. However, because the polishing properties of the nitride layer 106 and pad oxide 104 layer are similar, such methods lack the requisite sensitivity to consistently avoid damaging the active pad oxide layer 104. In addition, as such methods rely on the mechanical properties of relatively large mechanical devices, these processes tend to be too slow to provide precise endpoint detection.

Referring to FIG. 2, it is known that the acoustic and ultrasound resonances of a device depend on the device thickness and geometry. It is also known that as the mechanical properties of a semiconductor device change while undergoing polishing operations, such as CMP, the acoustic properties of the device also change. U.S. Pat. No. 5,222,329 to Yu discloses a system for detecting and controlling CMP using acoustical methods. The system of the '329 patent uses a microphone to detect acoustical waves in the range of 20–20,000 HZ generated when a wafer is subjected to CMP. The microphone is coupled to a spectrum analyzer which operates to analyze the intensity versus frequency characteristics of the acoustical waves. A CMP computer is coupled to the spectrum analyzer and controls a polishing machine in accordance with the acoustical signals.

U.S. Pat. No. 5,245,794 also employs acoustical waves to control a polishing machine. The '794 patent discloses the use of a transducer sensitive to acoustical waves in the range of 30–100 Hz coupled to an active filter, such as a phase locked loop, to derive control signals for a polisher controller.

Both the '329 and '794 patent suffer drawbacks. For example, because low frequency acoustical waves propagate over large distances, low frequency acoustic systems are susceptible to interference from ambient noise. In addition, the large propagation distance of such low frequency acoustic waves makes it difficult to get a local picture of the polishing rate. Therefore, these systems are not able to provide an indication of polishing uniformity.

SUMMARY OF THE INVENTION

Accordingly, there remains a need for improved systems and methods of endpoint detection during CMP, especially for shallow trench isolation devices The present invention provides systems and methods that substantially reduces or eliminates problems associated with prior polishing control systems and methods.

In accordance with the present invention, a system for controlling a polishing machine during polishing of a workpiece includes a carrier which has an interface surface for engaging a workpiece, such as a semiconductor wafer, and establishing ultrasonic coupling thereto. At least one crystal oscillator, which has a resonant frequency in an ultrasonic band which is indicative of a polishing depth of the workpiece, is ultrasonically coupled to the carrier. A detector circuit is operatively coupled to the at least one crystal oscillator and provides an output signal which is representative of an output level of the crystal oscillator. A processor circuit is operatively coupled to the detector circuit and provides a signal to the polishing machine which is indicative of a polishing depth, such as a desired polishing endpoint.

More specifically, the carrier can include a vacuum chuck for engaging the carrier to the workpiece. Further, the carrier can be formed with a number of wells therein with a crystal oscillator residing within each of the wells. In a further embodiment, the wells can be filled with an ultrasonic transmission medium to enhance the coupling between the carrier and the crystal oscillator within the wells. In another embodiment, the wells can be arranged in a spatial array about the interface surface of the carrier with a number of oscillators operating at a common resonant frequency residing therein. In such case, the processor can determine a common depth indication at a number of locations on the workpiece.

In an alternate embodiment, the wells can be arranged in a spatial array of well clusters about the interface surface of the carrier with a number of oscillators operating at a number of resonant frequencies which are indicative of a number of different polishing depths at various locations on the workpiece.

A method, in accordance with the present invention, of controlling a polishing machine during polishing of a surface of a workpiece includes the steps of monitoring ultrasonic emissions from a workpiece undergoing polishing by using a crystal oscillator having a resonant frequency; detecting the ultrasonic emissions having a frequency substantially equal to the resonant frequency of the crystal oscillator; and terminating polishing when the ultrasonic emissions have a frequency substantially equal to the resonant frequency of the crystal oscillator.

More specifically, the step of monitoring can include monitoring a number of crystal oscillators which are arranged in a spatial array. The detecting step can include localizing those emissions having a frequency substantially equal to the resonant frequency of the crystal oscillator to a portion of the surface of the workpiece. In addition, the terminating step can then selectively terminate polishing in the portions of the surface of the workpiece where the detected emissions have a frequency substantially equal to the resonant frequency of the crystal oscillator.

In a further method, a number of oscillators can operate at a number of resonant frequencies indicative of a number of different polishing depths and the detecting step can then include steps to determine which of the plurality of polishing depths is indicated. In such a method, before the terminating step, a step of altering the speed of the polishing machine in response to the detected polishing depths can be performed.

A technical advantage of the present invention includes providing systems and methods which employ ultrasound emissions to determine when a desired polishing endpoint has been reached and controlling a polishing operation accordingly. A further technical advantage is that the present systems and methods can detect a desired polishing depth at a number of locations on the workpiece to provide a measure of polishing uniformity. Another technical advantage of the present systems and methods is that a number of polishing depths can be determined at a number of locations and the polishing speed can be controlled accordingly.

Other technical advantages of the present invention will be readily apparent to one skilled in the art from the following figures, descriptions, and claims.

BRIEF DESCRIPTION OF THE DRAWINGS

For a more complete understanding of the present invention, and advantages thereof, reference is now made to the following description taken in conjunction with the accompanying drawings, wherein like reference numerals represent like parts, in which.

DETAILED DESCRIPTION OF THE INVENTION

The preferred embodiments of the present invention and its advantages are best understood by referring now in more detail to the drawings, in which like numerals refer to like parts.

Figure 1A:
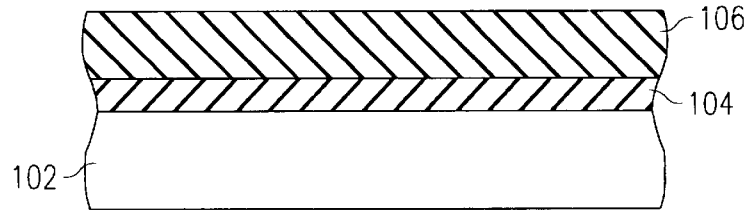
FIGS. 1A through 1D are schematic diagrams illustrating, in cross section, an exemplary shallow trench isolation device at various fabrication steps using Aideal@ chemical mechanical polishing (CMP)
Figure 1B:
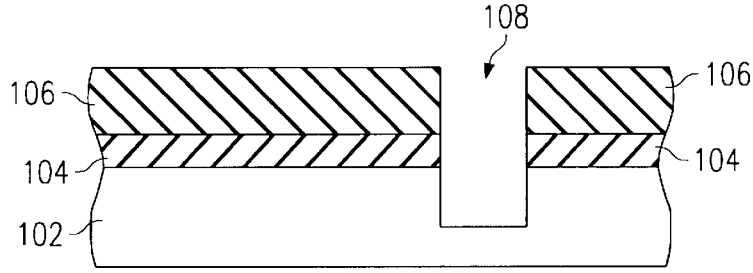
Figure 1C:
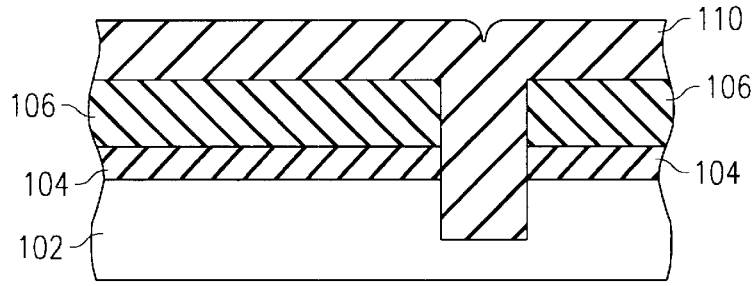
Figure 1D:
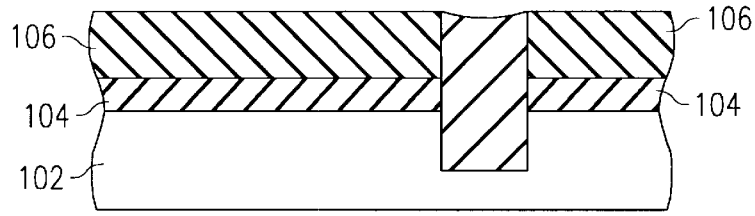
Figure 1E:
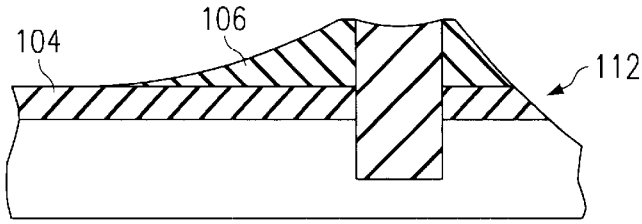
FIG. 1E is a schematic diagram illustrating a non-ideal result of conventional CMP on a device as illustrated in FIG. 1C.
Figure 2:
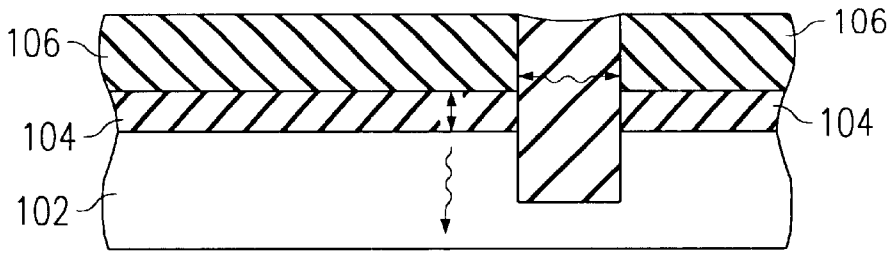
FIG. 2 is a schematic diagram illustrating the propagation of acoustic signals in a typical STI device.

A system for controlling a polishing machine in accordance with the present invention detects changes in ultrasonic emissions from a semiconductor device (i.e., a workpiece) undergoing polishing to determine a desired control point or endpoint. As the mechanical properties of a workpiece change while undergoing polishing, such as CMP, the ultrasound resonance of the device changes accordingly. As illustrated in FIG. 2, during CMP, vibrations generated by mechanical interactions between the surface of the workpiece and the slurry or pad of CMP machine are reflected from material interfaces giving rise to characteristic mechanical and ultrasound resonant properties. As CMP progresses, the resonant frequency of these vibrations change. Thus, the spectrum of emitted ultrasound will generally be a characteristic of the geometry and thickness of the workpiece being subjected to polishing. By detecting and analyzing these emissions, endpoint detection during CMP can be achieved.

Figure 3:
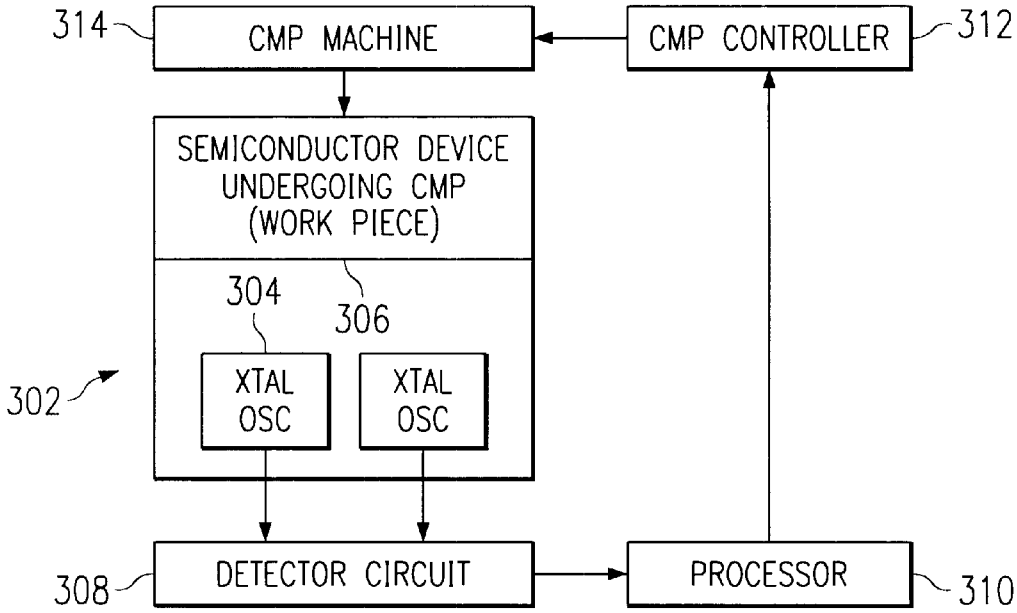
FIG. 3 is a schematic diagram of a system for controlling a polishing machine in accordance with the present invention.

FIG. 3 is a schematic diagram of an exemplary system for controlling a polishing machine in accordance with the present invention. The system includes a carrier 302 to which at least one crystal oscillator 304 is ultrasonically coupled. The carrier 302 includes an interface surface 306 which is adapted to establish an ultrasound transmitting interface with a semiconductor device undergoing CMP. The crystal oscillators 304 each have an output port which is operatively coupled to a corresponding detector circuit 308 or corresponding input to a common detection circuit 308. The detector circuit 308, which can take the form of a diode or other detector circuit topology known in the art, converts the ultrasound signal from the respective oscillator circuit 304 into an amplitude signal which is proportional to the peak output of the oscillator circuit 304. The detector circuit 312 is operatively coupled to a processor circuit 310, such as a microprocessor, preferably having a suitable analog to digital converter contained therein. The processor circuit 310 analyzes the amplitude signals from the detectors 304 and determines when the desired endpoint of the CMP operation has been reached. In one embodiment, the processor circuit 310 can take the form of a comparator circuit having a suitable reference voltage.

The processor 310 is operatively coupled to a CMP controller 312 which in turn is operatively coupled to a CMP machine 314. The CMP machine 314 includes a working surface, such as a platen and slurry system (not shown) for operating on the surface of the semiconductor device (workpiece) undergoing CMP. Upon detection of a signal from detector 308 indicative that an endpoint has been reached, the processor 310 provides a signal to CMP controller 312 to stop the operation of the CMP machine 314.

Figure 4:
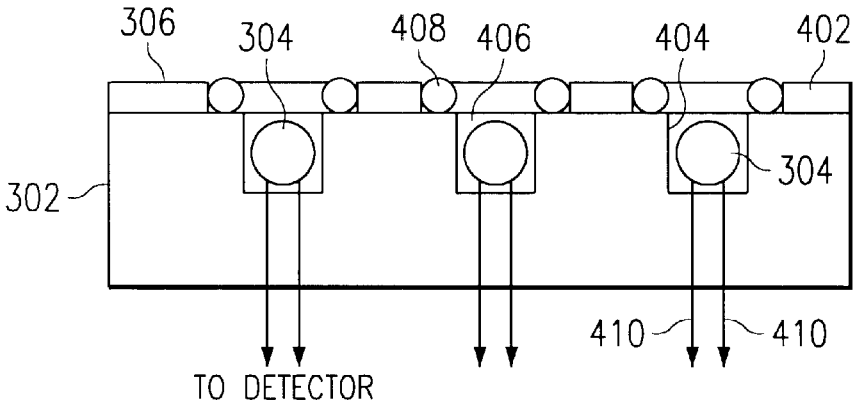
FIG. 4 is a cross-sectional view of a carrier portion of a system formed in accordance with the present invention.

FIG. 4 is a cross sectional diagram further illustrating the carrier 302 portion of the system described in connection with FIG. 3. The carrier 302 has an interface surface 306 which is an exposed surface of a mechanical interface portion 402. The mechanical interface portion 402 can take the form of a vacuum chuck, which are commonly used in semiconductor handling applications. The mechanical interface portion 402 is adapted to couple the carrier 302 to a work piece and establish both an ultrasonic and a mechanical interface. Within the carrier 302 are wells 404 in which the crystal oscillators 304 preferably reside. Preferably, the void surrounding the crystal oscillator 304 within wells 404 are filled with an ultrasonic transmission medium 406, such as water. When the ultrasonic transmission medium 406 is a fluid, such as water, each well 404 is generally provided with a well sealing member 408, such as an 0-ring seal around the perimeter of the well openings. The openings of the wells 404 on the interface surface 306 are then closed by engagement of the carrier 302 with the workpiece, i.e., the substrate of the device undergoing CMP.

The crystal oscillators 304 have electrical conductors 410 coupled thereto to couple the signal from the oscillator 304 to the detector circuit 308. The electrical conductors 410 extend through apertures in the carrier 302 which are subsequently sealed to maintain the fluid containing integrity of wells 404.

Figure 5:
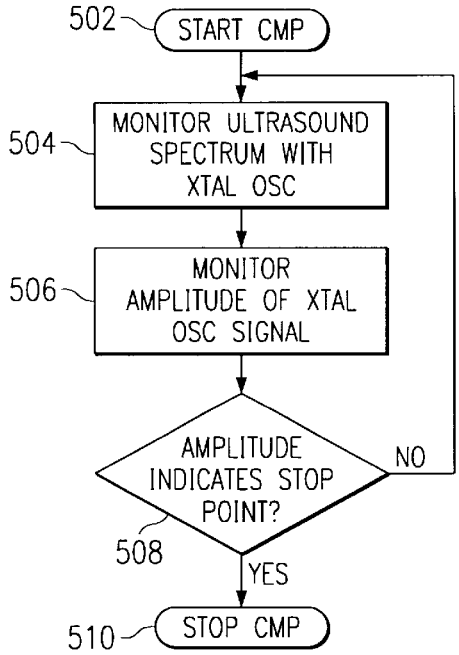
FIG. 5 is a flow chart of a method for controlling a polishing machine in accordance with the present invention.

FIG. 5 is a flow chart illustrating a method of controlling a polishing process, such as CMP, in accordance with the present invention. The process is initiated when polishing begins (step 502). During CMP, ultrasound emissions from the device which is subjected to polishing are coupled to the crystal oscillators 304 (step 504). The crystal oscillators 304 are configured to have a resonant frequency which is substantially equal to the resonant frequency of the device undergoing CMP when polished to the desired thickness and generate an increased signal amplitude output signal when the device undergoing CMP exhibits resonance at the resonant frequency of the oscillator 304. When the resonant element of the crystal oscillator is quartz, a thickness mode crystal having a thickness substantially equal to the desired thickness of the material undergoing CMP can achieve this result. The output amplitude of the oscillator 304 is monitored to determine when the device undergoing CMP is at the proper thickness (step 506). Step 506 is generally performed by monitoring the DC signal level from the detector circuit 308 at the processor 310. If the amplitude of the oscillator signal does not indicate that a stop point has been reached, Steps 504–508 are repeated (step 508). If a stop point has been reached, CMP is terminated (step 510), such as by processor 310 providing a suitable signal to CMP controller 312.

Figure 6:
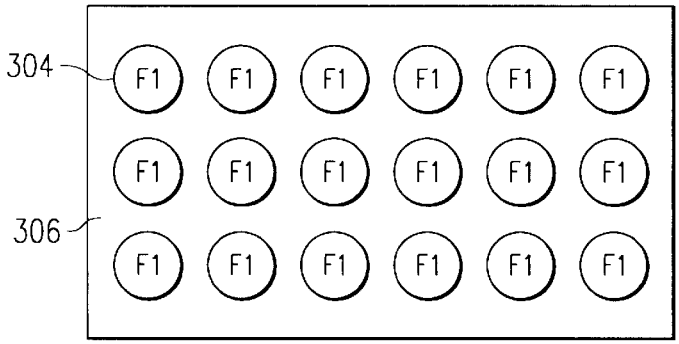
FIG. 6 is a top plan view of an interface surface of a carrier portion for an embodiment of the present invention which employs a plurality of oscillators operating at a common resonant frequency.
Figure 7:
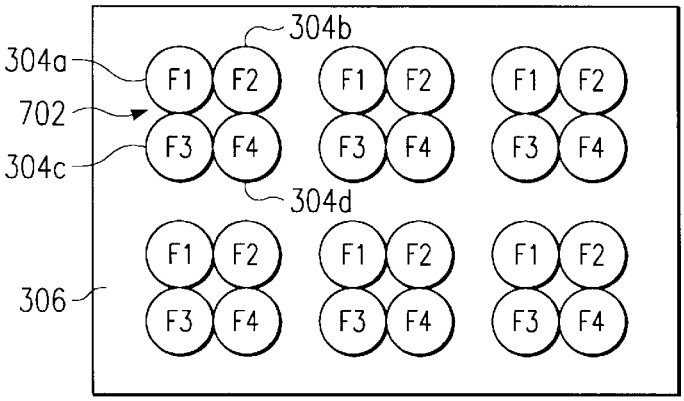
FIG. 7 is a top plan view of an interface surface of a carrier portion for an alternate embodiment of the present invention which employs a plurality of oscillators, arranged in clusters, which operate at a plurality of resonant frequencies.

Preferably, a plurality of crystal oscillators 304 are employed in the present system and methods. In one such an embodiment, illustrated in FIG. 6, the plurality of crystal oscillators 304 can operate at a common resonant frequency (F1) and be arranged as a spatial array to take measurements at a plurality of locations on a relatively fine grid. Alternatively, as illustrated in FIG. 7, the oscillators 304*a, b* and *c*, can operate at a plurality of resonant frequencies (such as F1, F2, F3 and F4) and can be arranged as clusters 702 to cover a band of expected resonant frequencies of the workpiece. While the clusters depicted include four oscillators operating at four different resonant frequencies, other numbers of oscillators and frequencies (i.e., 2, 3, 5, 6, etc.) can be employed in each cluster depending on the number of depths to be monitored. In the cluster embodiment, the frequencies are generally selected to correspond with different polishing depths approaching the end point. In this case, by a modification to step 510, the polishing speed can be reduced in steps as the endpoint is being approached.

Although the present invention has been described with several embodiments, various changes and modifications may be suggested to one skilled in the art. It is intended that the present invention encompass such changes and modifications as fall within the scope of the appended claims.

What is claimed is:

1. A system for controlling a polishing machine during polishing of a surface of a workpiece, comprising:

a carrier, said carrier having an interface surface for engaging a surface of said workpiece opposed to said surface of said workpiece being polished, said workpiece being capable of emitting ultrasonic emissions indicative of its instantaneous depth or thickness and establishing ultrasonic coupling thereto;

at least one crystal oscillator ultrasonically coupled to said carrier, said at least one crystal oscillator having a resonant frequency in an ultrasonic band which is indicative of a predetermined polishing depth or thickness of the workpiece;

a detector circuit operatively coupled to said at least one crystal oscillator, said detector circuit providing an output signal which is representative of the output level of said at least one crystal oscillator and responsive to the instantaneous polishing depth or thickness; and a processor circuit responsive to said output signal from said detector circuit to provide a signal to the polishing machine indicative of polishing depth and, upon sensing operation at said predetermined polishing depth or thickness of said workpiece due to said oscillator operating at its resonant frequency to cause termination of polishing upon said processor providing thereto an indication that said oscillator is operating at its resonant frequency.

2. The system for controlling a polishing machine of claim 1, wherein said carrier includes a plurality of wells therein and said at least one crystal oscillator resides within said wells.

3. The system for controlling a polishing machine of claim 2, wherein said wells are filled with an ultrasonic transmission medium.

4. The system for controlling a polishing machine of claim 2, wherein said wells are arranged in a spatial array about said interface surface and said at least one crystal oscillator includes a plurality of oscillators operating at a common resonant frequency.

5. The system for controlling a polishing machine of claim 4, wherein the processor is responsive to signals from the detector for each of the plurality of oscillators to determine a polishing depth at a plurality of locations on the workpiece.

6. The system for controlling a polishing machine of claim 2, wherein said wells are arranged in a spatial array of well clusters about said interface surface and said at least one crystal oscillator includes a plurality of oscillators operating at a number of resonant frequencies.

7. The system for controlling a polishing machine of claim 6, wherein the processor is responsive to signals from the detector for each of the plurality of oscillators to determine a number of polishing depths at a plurality of locations on the workpiece.

8. The system for controlling a polishing machine of claim 1, wherein the carrier further includes a vacuum chuck for engaging the workpiece.

9. A system for polishing a workpiece, comprising:

a polishing machine having a working surface for polishing a surface of the workpiece;

a polishing machine controller, said polishing machine controller being operatively coupled to the polishing machine for controlling said working surface;

a carrier, said carrier having an interface surface for engaging a surface of a workpiece opposed to a surface of a workpiece being polished, said workpiece being capable of emitting ultrasonic emissions indicative of the instantaneous thickness of said workpiece and establish ultrasonic coupling thereto;

at least one crystal oscillator ultrasonically coupled to said carrier, said at least one crystal oscillator having a resonant frequency in an ultrasonic band which is indicative of a predetermined polishing depth or thickness of the workpiece;

a detector circuit operatively coupled to said at least one crystal oscillator, said detector circuit providing an output signal which is representative of an output level of said at least one crystal oscillator and responsive to the instantaneous polishing depth or thickness; and a processor circuit operatively coupled to said detector circuit, said processor circuit providing a signal to the polishing machine controller indicative of a polishing depth or thickness of said workpiece and causing termination of polishing responsive to said resonant frequency.

10. The system for polishing a workpiece of claim 9, wherein said wells are filled with an ultrasonic transmission medium.

11. The system for polishing a workpiece of claim 9, wherein said carrier includes a plurality of wells therein and said at least one crystal oscillator resides within said wells.

12. The system for polishing a workpiece of claim 11, wherein said plurality of wells are arranged in a spatial array about said interface surface and said at least one crystal oscillator includes a plurality of oscillators operating at a common resonant frequency.

13. The system for polishing a workpiece of claim 12, wherein the processor is responsive to signals from the detector for each of the plurality of oscillators to determine a polishing depth at a plurality of locations on the workpiece and providing a signal to said polishing machine controller to effect substantially uniform polishing of the surface of the workpiece.

14. The system for polishing a workpiece of claim 9, wherein said plurality of wells are arranged in a spatial array of well clusters about said interface surface and said at least one crystal oscillator includes a plurality of oscillators operating at a number of resonant frequencies.

15. The system for controlling a polishing machine of claim 14, wherein said polishing machine working surface is operable at a plurality of polishing speeds; and said processor is responsive to signals from the detector for each of the plurality of oscillators to determine a number of polishing depths at a plurality of locations on the workpiece and provides a signal to the polishing machine controller to select one of the plurality of operating speeds.

16. The system for controlling a polishing machine of claim 9, wherein the carrier further includes a vacuum chuck for engaging the workpiece.

17. A method of controlling a polishing machine during polishing of a surface of a workpiece, comprising:

monitoring ultrasonic emissions from a workpiece capable of emitting ultrasonic emissions indicative of its instantaneous thickness during polishing using a crystal oscillator having a resonant frequency;

detecting the ultrasonic emissions; and terminating polishing when the ultrasonic emissions have a frequency substantially equal to the resonant frequency of the crystal oscillator.

18. The method of claim 17, wherein:

the step of monitoring further comprises monitoring a plurality of crystal oscillators arranged in a spatial array;

said detecting step further comprises localizing the emissions having a frequency substantially equal to the resonant frequency of the crystal oscillator to a portion of the spatial array; and said terminating step comprises terminating polishing in portions of the surface of the workpiece corresponding to those portions of the spatial array where the emissions have a frequency substantially equal to the resonant frequency of the crystal oscillator.

19. The method of claim 18, wherein the plurality of oscillators operate at a plurality of resonant frequencies and wherein said detecting step further comprises determining one of a plurality of polishing depths indicated by the plurality of frequencies.

20. The method of claim 19, further comprising the step, before said terminating step, of altering the speed of the polishing machine in response to the plurality of detected polishing depths.

* * * * *